US005134565A

United States Patent [19]

Herbertz

[11] Patent Number: 5,134,565

[45] Date of Patent: Jul. 28, 1992

[54] ELECTRONIC SCORING DEVICE FOR TENNIS COMPETITIONS

[76] Inventor: Heinz Herbertz, Salierstrasse 19, 8600 Bamberg, Fed. Rep. of Germany

[21] Appl. No.: 672,660

[22] Filed: Mar. 22, 1991

[30] Foreign Application Priority Data

Dec. 21, 1990 [DE] Fed. Rep. of Germany ..... 4041419

[51] Int. Cl.[5] ..... G07C 1/22; G07C 1/28

[52] U.S. Cl. ..... 364/411; 273/DIG. 26; 340/323 R

[58] Field of Search ..... 364/410, 411; 340/323 R; 273/DIG. 26, 29 R

[56] References Cited

U.S. PATENT DOCUMENTS

| | | | |
|---|---|---|---|
| 3,730,131 | 5/1973 | Izzo | 116/120 |
| 4,045,788 | 8/1977 | Castelli | 340/323 R |
| 4,058,971 | 11/1977 | Epperson | 58/39.5 |
| 4,097,855 | 6/1978 | Salvo | 340/323 R |
| 4,198,810 | 4/1980 | Fahremachon | 368/239 |
| 4,237,372 | 12/1980 | Zevgolis | 235/926 A |
| 4,266,214 | 5/1981 | Peters . | |
| 4,283,784 | 8/1981 | Horan | 368/87 |
| 4,286,323 | 8/1981 | Meday | 364/411 |
| 4,432,058 | 2/1984 | Supran | 364/410 |
| 4,498,668 | 2/1985 | Bowen | 273/73 R |
| 4,879,651 | 11/1989 | Little | 364/411 |

FOREIGN PATENT DOCUMENTS

| | | | |
|---|---|---|---|
| 2706488 | 8/1978 | Fed. Rep. of Germany . | |
| 3038094 | 5/1982 | Fed. Rep. of Germany . | |
| 3146855 | 6/1983 | Fed. Rep. of Germany . | |
| 8900240.7 | 11/1989 | Fed. Rep. of Germany . | |
| 2561934 | 4/1984 | France | 273/DIG. 26 |
| 8400938 | 3/1984 | Netherlands | 273/29 R |

OTHER PUBLICATIONS

"Timepieces" magazine, May 1989, pp. 89, 110.

*Primary Examiner*—Dale M. Shaw
*Assistant Examiner*—A. Bodendorf
*Attorney, Agent, or Firm*—Wigman & Cohen

[57] ABSTRACT

A device for controlling tennis competitions with a scoring display for the public or in miniaturized form on a device carried by the tennis player. There are push-buttons for each opponent to enter the winning points into a computer and the scoring display shows the results in the usual way for tennis. An input before the match states the right of service for the following games including tie breaks, which will also be shown on the scoring display. With the inputs stop watch timer(s) start to run and control the time rules of the tennis competitions, which may be shown by analog signs around the circumference of the scoring display in one embodiment. With a functional push-button one can switch to the scoring display the real time and other important dates for tennis competitions.

27 Claims, 3 Drawing Sheets

FIG. 2
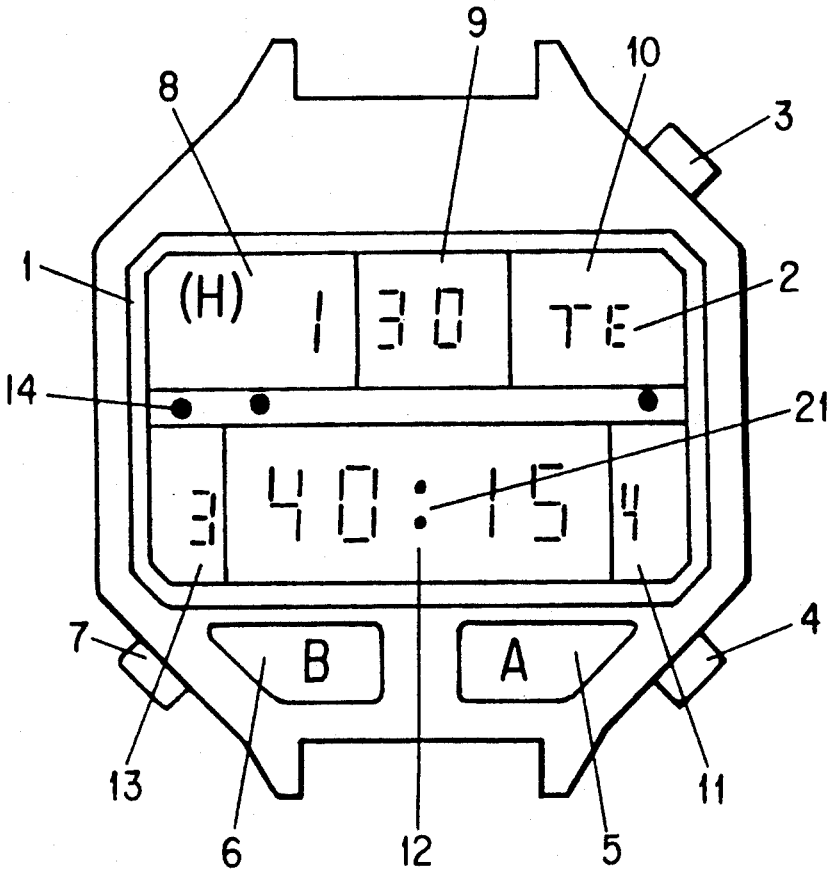
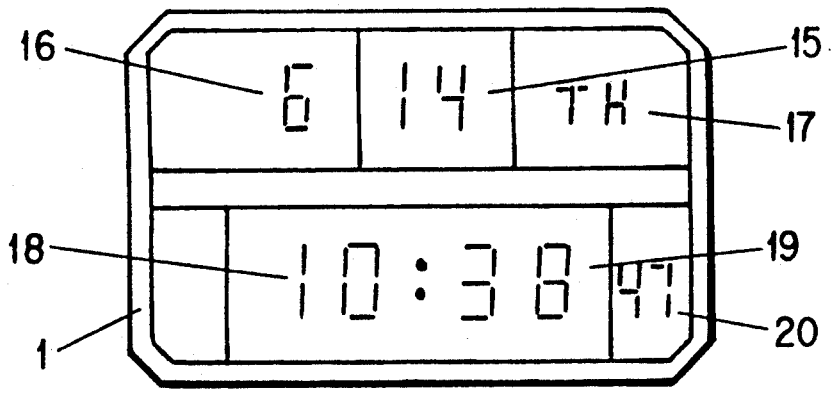
FIG.3

ELECTRONIC SCORING DEVICE FOR TENNIS COMPETITIONS

BACKGROUND OF THE INVENTION

1. Field of the Invention

The invention relates to a device for scoring tennis games with push-buttons for each opponent for the input of the winning points into a computer. The latter transfers the scores to a scoreboard and displays it in the usual way of tennis.

In addition to the counting of points, the rules of tennis make time control necessary; since after a rally the ball must be back in the game within 30 seconds. When the players change sides, an additional pause of 60 seconds is allowed. To get used to the court the opponents agree on a warm-up time, not longer than 5 minutes. The total time of the match will also be recorded.

2. Description of the Prior Art

A device for counting and scoring of the kind mentioned above is disclosed by DE-OS-27 06 488. The notice of the score takes place on a scoreboard for the public or on a score keeping device carried on the wrist, i.e., wrist watch. The way of scoring in tennis, which is very different from other sporting competitions, is also described therein. There is a vast literature on the way of counting, scoring and time rules, see e.g., Dieter Birkner, BLV Verlagsgesellschaft, Munich West Germany, 1987.

OBJECTS AND SUMMARY OF THE INVENTION

The devices for counting and scoring described in the prior art are not suitable to control time rules and therefore it is necessary to operate a second device for this purpose and the concentration of players and umpires on the actual game will be reduced by performance of the separate time-keeping function.

An object of the present invention is to provide a device which performs all functions of counting and time control with clearly arranged scoring and which is simple to operate.

Another object of the present invention is to provide a scoring device which includes actuation push-buttons for the input of scoring points, and for starting the timer.

A further object of the invention is to provide the apparatus with a computer, and to program the computer with an instruction set (or computer program per se) in such a manner that, in addition to the actual score, successively or simultaneously, one or several of the following notices appear on the scoreboard: the time after a rally, the time elapsed, the total number of won/-lost games for each player, the day, the date, and real time.

The device according to one embodiment of the invention has the advantage that the counting of points, the calculation of the score and the control of time can be carried out with only one appliance. Important facts of the tennis competition will be memorized or stored without any additional operation and can be readily displayed when needed.

The device according to another embodiment of the invention has the advantage that the player can see with a glance to the scoreboard both the score and the time allowed for break. This makes it possible for the player to take full benefit of the allowed pause when ahead by big points and after long, strenuous rallies.

With the foregoing and other objects, advantages, and features of the invention which will become hereinafter apparent, the nature of the invention may be more clearly understood by reference to the following detailed description of the invention, the appended claims, and to the several views illustrated in the attached drawings.

BRIEF DESCRIPTION OF THE DRAWINGS

The exemplary embodiments of the invention are shown on the drawings, in which:

FIG. 2 shows a second embodiment of my electronic scoring device for tennis competition; and FIG. 3 shows a scoreboard of my second embodiment scoring device after switching over to real time display.

DETAILED DESCRIPTION OF THE PREFERRED EMBODIMENTS

The electronic scoring device for tennis competitions according to my invention includes a microprocessor and a scoreboard. Exemplary embodiments of the present invention include a pocket watch, a wrist watch, or mounted into a tennis racket. It can also be incorporated into a scoreboard of the proper size for spectators viewing a tennis tournament. The drawings show only exemplary embodiments of the invention.

Figure 1:
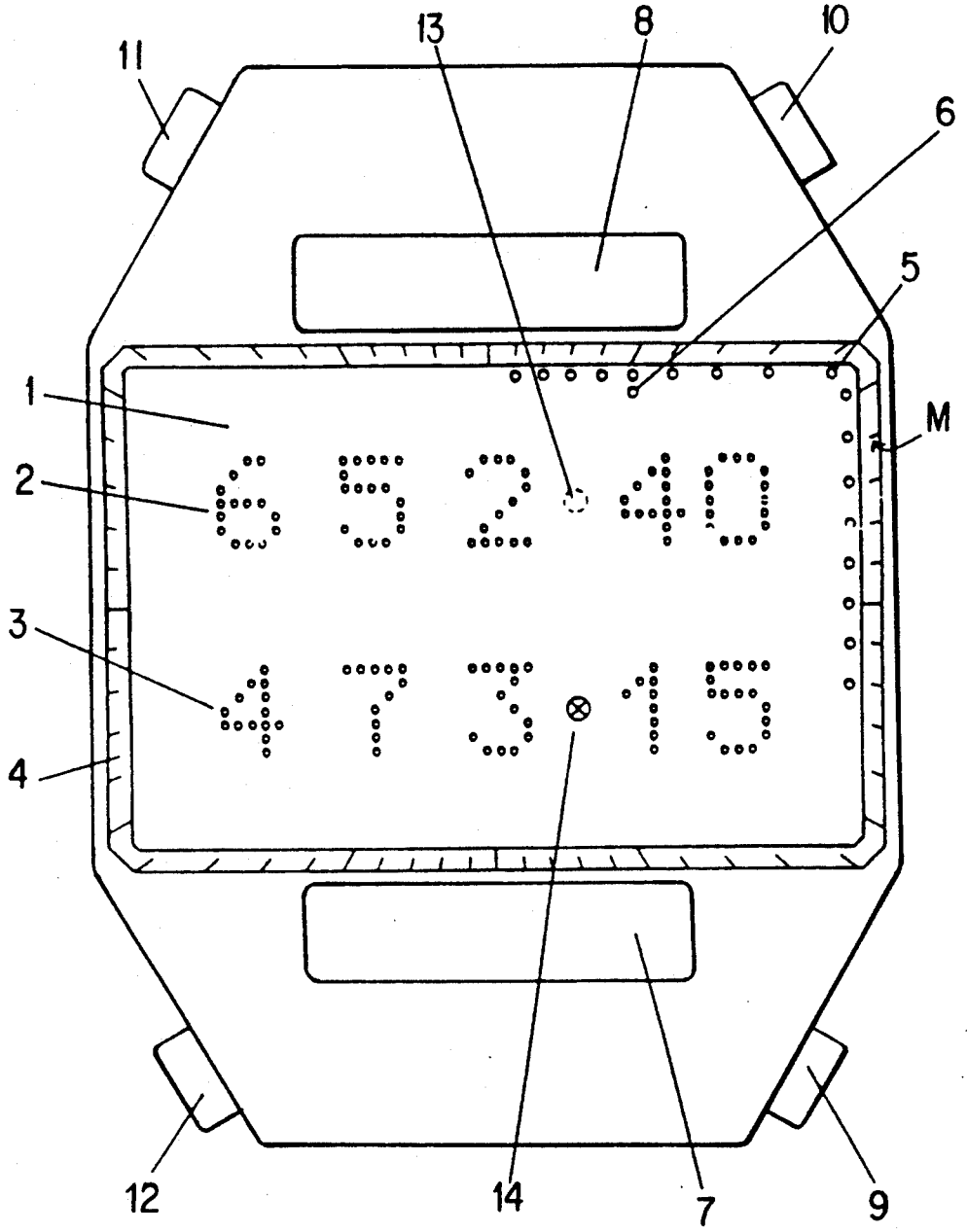
FIG. 1 shows a first embodiment of my electronic scoring device for tennis competition.

Referring now to my first embodiment of the invention, as shown in FIG. 1, the scoreboard 1 with this first arrangement can be of any size, i.e., it may be sized to include a microprocessor for use in a wristwatch or for spectators viewing a tennis tournament. For each opponent there is a row of digits 2 and 3 in a rectangular frame 4. At the circumference of the frame 4 are sixty spaced marks designated b the letter M. These marks M are directed to the center in angles of 6°. For clarity, every fifth mark is a little longer than those therebetween. When the timer is started, under the marks after each second appears a sign of the row 5 illuminated by a small bulb or by a liquid display such as a L.C.D. After each minute appears a sign of the row 6, the latter includes 12 signs on the circumference. This analog notice of time control is easy to survey.

The push-button 7 belongs to the row of digits 3, normally for the score of the wearer of the watch. The push-button 8 and the row of digits 2 is for his opponent. With push-button 9 one can delete wrong inputs on push-button 7, and wrong inputs on push-button 8 with push-button 10. Push-button 11 is for cancellation of all inputs. Push-button 12 is for calling up different functions which will be displayed on scoreboard 1. In the row of digits 2 is a signal 13 and in the row of digits 3 is a signal 14 to indicate who is to serve.

Figure 4:
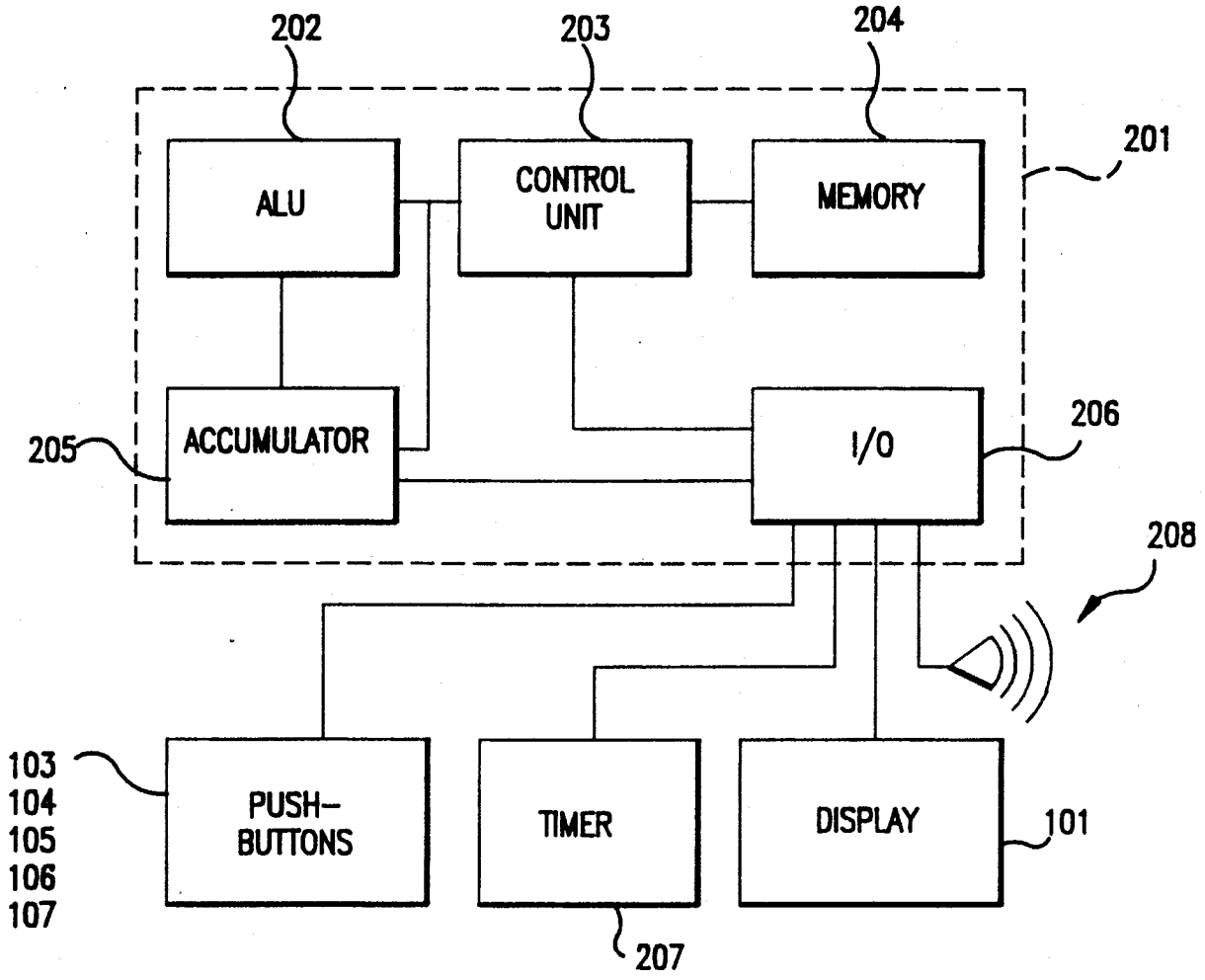

For illustration purposes, an embodiment of the invention configured as a device to be carried on the wrist of the free arm, including a microprocessor-based computer is described and shown. Such microprocessors conventionally include memory, input/output interfaces, buffer, clock, and arithmetic logic functions. Such microprocessor-based computers have become particularly well known in recent years. An illustration of the invention including such a microprocessor 201 is shown in FIG. 4. Arithmetic Logic Unit ("ALU") 202 performs logical operations such as AND, OR, etc., and arithmetic operations such as addition, subtraction, multiplication, and division. A control unit 203 directs operation of the computer from memory 204 instructions and executes these instructions. Usually, an accumulator 205 is included to temporarily store data. An I/O function block 206 handles the input and output operations, sending and receiving signals to and from the microprocessor. Often, a timer 207 is included within the microprocessor chip. Alternatively it may be physically located outside (or supplement) the microprocessor as shown. Data is shown on a display unit 101. Input signalling may be accomplished by switches, including push-buttons 103–107 in this example. An audible alarm 208 may derive its drive signal via the microprocessor 201 or by a signal generator associated with the alarm 208. The computer could be programmed for any of the following functions.

First the player actuates push-button 12 to call the function "Tennis" and on the scoreboard 1 the result of the match before will be displayed. After cancellation by push-button 11 the player identifies who is to serve, himself for example, by push-button 7, indicated by sign 14, and for his opponent, by push-button 8, indicated by sign 13. This is only to register who is to serve and no point will be counted, but the timer will be started to control the warm-up time. By subsequent actuation of the push-buttons 7 or 8 the points for the player or his opponent will be counted and the timer starts again each time anew. In a completed game, the signs 13 and 14 change and indicate who is to serve for the next game.

The great capacity and the small size of modern microprocessor-based computers make it possible to program different tie break regulations, which can be called up by functional push-button 12.

Most tennis matches will be decided by the "best of three" with tie breaks at 6:6 games; that means a maximum of 3 sets. For a fast decision some tournaments have "long sets" with 9 games. The winner must have an advantage of 2 games or win the tie break which follows 8:8 games. Normally, only in men's Grand Prix tournaments will they play "best of five" (maximum: 5 sets).

On the scoreboard of FIG. 1, the following forms of display are possible. One can see which program is on display and eventually change before the game starts.

| "best of three" | "long set" | "best of five" |
|---|---|---|
| 0 0 0 00 | 0 00 | 0 0 0 0 0 |
| 0 0 0 00 | 0 00 | 0 0 0 0 0 |
| Examples of provisional results: | | |
| 6 2 . 40 | 7 40 | 2 6 6 |
| 4 3 A | 8 . 40 | 2 6 . 6 |
| Examples of final results: | | |
| 6 6 5 | 7 | 3 6 7 4 6 |
| 4 7 7 | 9 | 6 4 5 6 7 |

The display of deuce is 40:40. "A" is for advantage. The provisional result of the "best of five" match notices a tie break, the first digits in the rows are for the sets won by each player, the second digit tells the number of games won in the current set. When the match is finished all games are listed as shown at examples of final results.

On the FIG. 1 scoreboard the player can see at a glance the actual score, who is to serve, and how much time he has to prepare for the next rally.

In FIG. 2, the second embodiment is shown. The scoreboard 101 is switched from the real time-display to tennis display by a push-button 107. This is indicated by reference numeral 102 for functional sign "TE".

There are five push-buttons in total: 103, 104, 105, 106, and 107, for adjustment of the real time and for tennis. In the upper row of digits on the scoreboard 101 is a compartment 108 for the alternative display of the hours of elapsed time, the minutes of the warm-up time and the minute for the pause, when players change the sides of the court. The display of hours will be indicated by the letter "H". Compartment 109 shows the seconds of the pauses between rallies, or the minutes of elapsed time. Compartment 110 shows the sign "TE" indicating tennis function.

A compartment 111 in the lower row of digits on the scoreboard 101 shows the number of games won by player A and a compartment 113, those of player B. Compartment 112 displays the points for the player A on the right side and the points for the player B on the left side in the usual way of tennis, i.e., 15, 30, 40. Each deuce will be displayed by 40:40 and each advantage by flashing of the 40 on the side of the advantage player. In the narrow middle row appear points 114 on the side of the player for each set won.

The numbers and letters are displayed by matrixes consisting of LCD points or lines but the "H" and the points for the sets appear as complete signs, controlled by the microprocessor.

FIG. 3 shows the scoreboard 101 after switching to real-time display by actuation of push-button 107. By means of the LCD-matrixes mentioned, the following will be announced: the date at 115, the months at 116, the days of the week at 117, the hours at 118, the minutes at 119 and the seconds at 120.

Scoring and time control according to the tennis rules will be practiced as follows: by actuating push-button 107 the scoreboard 101 is switched to tennis and compartment 109 shows the sign "TE" (see FIG. 2) To delete the display of the match before, push-button 104 is to be pressed for approximately 5 seconds. When starting warm-up push-button 103 will be pressed for time control and an audible beep tone is generated. The colon 121 flashes and the elapsed warm-up time is shown, the seconds in compartment 109 and the minutes being shown in compartment 108. The flashing colon indicates that points can be registered with push-button 105 for player A and with push-button 106 for player B. The warm-up time may then be finished and scoring of points begun.

Each time a point is scored by pressing push-button 105 or push-button 106, the display in the compartments 108 and 109 is reset to zero and immediately starts again for the time control between the rallies. The player reads the score and the time to start a new rally at the latest. At a score of 6:6 games the microprocessor goes to tie break rules and the display in compartment 112 shows the tie break results.

When one of the opponents wins a game or a set a beep tone is generated. Two or more beep tones are for two sets won by a player in one match (best of three). Now one can read the elapsed time in the compartments 108 and 109. If the opponents have agreed on "best of five" the player must actuate push-button 103 and points will be registered until one of the opponents has won 3 sets in this match and beep tones and display act as before. More than 99 percent of all tennis matches are decided by "best of three" and in all these cases no input for the number of winning sets is necessary.

During the match the elapsed time can be displayed in hours and minutes by briefly pressing push-button 103. A second short press switches back to scoring. To delete all inputs push-button 104 has to be kept pressed (approximately 5 seconds) until the display goes to zero.

The control of time rules can be practiced by countdowns, too. The advantage here is that the different times for pauses are stored in the microprocessor and brought to the display when the countdown starts. When the addition of games in one set is an odd number the countdown starts in compartments 108 and 109 at 1 minute, 30 seconds and the player is then reminded that the sides of the court have to be changed.

The time rules in tennis may be subject to changes. The program instruction set of the electronic scoring device therefore can also be changed as follows: push-button 103 will be kept pressed (approximately 5 seconds) until the digit starts to flash. For prolongation of time, push-button 105 is pressed and for shortening, push-button 106 is pressed. By a short pressing of push-button 103 the next digit will flash and time can be changed the same way. The actuation of push-button 7 finishes the setting.

The combination of functions and push-buttons can, of course, be different in other programs according to the invention and within the intended scope of the appended claims.

At the end of every pause, the electronic device generates a beep tone. Also advantageous is also a signal which can be programmed to occur a few seconds before the time runs out, but in case the embodiment of the invention is carried on the wrist or mounted into a racket, the beep tone could disturb the player should the rally start before the allowed pause ends. This can be prevented by a shock or movement sensor which cuts off the beep tones when the player moves.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. An electronic scoring device for tennis match competition between teams, each team having at least one player, comprising:

a) push-buttons for the input of score data into a microprocessor with separate push-buttons for each team;

b) a timer for keeping time; and c) a display for visual display of score data and time information;

wherein said microprocessor transfers score data to said display for visual display according to the rules of tennis, wherein each of said team push-buttons 1) inputs score data and 2) starts the timer; and wherein said display shows both score data and time information after each rally.

2. The device of claim 1, wherein said display displays an actual score and a time period after a rally.

3. The device of claim 1, wherein the display displays an actual score and an elapsed time period.

4. The device of claim 1, wherein the teams win and lose games, and the display displays the number of games won and lost.

5. The device of claim 1, further including a day of the week display.

6. The device of claim 1, further including a date display.

7. The device of claim 1, further including a time of day display.

8. The device of claim 1, said display further including rows of digits and indicator means around the rows of digits for analog time display.

9. The device of claim 1, further including a timer interrupt push-button.

10. The device of claim 1, wherein the microprocessor controls display of the score data and permitted times for delay of the tennis match, said delay including at least one of warmup and pauses, in seconds and minutes.

11. The device of claim 1, wherein said display is a LCD.

12. The device of claim 1, wherein said microprocessor determines when addition of games in a set results in an odd number, and adds 1 minute more to an allowed time period.

13. The device of claim 1, wherein the teams win and lose games, and the display displays the total number of won and lost games for each team.

14. The scoring device of claim 1, wherein each one of said team push-buttons, when actuated, starts the timer simultaneously with score data entry.

15. The scoring device of claim 1, wherein each one of said team push-buttons, when actuated, causes the display to show the allowed time for passes in a countdown mode and starts the countdown simultaneously with score data entry.

16. The scoring device of claim 1, wherein said player push-buttons comprise respective first and second push-buttons, further including a third push-button adapted to pause displayed times when pressed and to indicate the pause by flashing the displayed times, a fourth push-button adapted to extend the time, a fifth push-button adapted to reduce the time, and a sixth push-button adapted to complete the setting.

17. The scoring device of claim 1, further including a signal generator for sounding an audible signal at the end of a permitted pause.

18. The scoring device of claim 1, further including a signal generator for sounding an audible signal shortly before the end of a permitted pause.

19. The device according to claim 1, wherein entry of score data for each team is entered by a separate push-button, and wherein the push-button assigned each team is of a different color.

20. The device of claim 1, further including a second timer and wherein said display displays a delay period.

21. The device according to claim 10, wherein entry of score data for each team is by a separate push-button, further including color coding the push-button assigned each team.

22. The scoring device of claim 17, further including a push-button for silencing said audible signal.

23. The scoring device of claim 18, further including a push-button for silencing said audible signal.

24. In an electronic scoring device for tennis match competition between teams, each team having at least one player, including push-buttons for the input of score data into a microprocessor with separate push-buttons for each player, a timer, and a display for score data and time information, the method of keeping score and displaying same comprising;

a) scoring the match on said scoring device;

b) timing events of the tennis match; and c) displaying said score data and said event timing, wherein timing of said events is initiated simultaneously with entry of a scoring event by pressing one of said push-buttons.

25. The method of claim 24, further including the steps of accumulating score data, recording time periods, and controlling the display with said microprocessor.

26. The method of claim 24, wherein the events timed include periods of delay, further including the step of adjusting the period of delay by depressing one of said push-buttons.

27. The method according to claim 24, wherein a separate color coded push-button is provided for entry of score data for each respective team, further including the step of entering score data for each team according to the color coding of the push-button assigned each team.

* * * * *